US009844269B2

(12) United States Patent
Bryant

(10) Patent No.: US 9,844,269 B2
(45) Date of Patent: Dec. 19, 2017

(54) MOTORIZED LINKAGE MECHANISM FOR HI-LEG SEATING UNIT

(71) Applicant: L&P PROPERTY MANAGEMENT COMPANY, South Gate, CA (US)

(72) Inventor: Jason Allan Bryant, Fulton, MS (US)

(73) Assignee: L&P Property Management Company, South Gate, CA (US)

( * ) Notice: Subject to any disclaimer, the term of this patent is extended or adjusted under 35 U.S.C. 154(b) by 238 days.

(21) Appl. No.: 14/884,638

(22) Filed: Oct. 15, 2015

(65) Prior Publication Data

US 2016/0029800 A1 Feb. 4, 2016

Related U.S. Application Data

(63) Continuation-in-part of application No. 14/771,404, filed as application No. PCT/US2014/037686 on May 12, 2014.

(60) Provisional application No. 61/991,171, filed on May 9, 2014, provisional application No. 61/822,075, filed on May 10, 2013.

(51) Int. Cl.

| | |
|---|---|
| ***A61G 5/14*** | (2006.01) |
| ***A47C 1/034*** | (2006.01) |
| ***A47C 1/024*** | (2006.01) |
| *A47C 1/0355* | (2013.01) |
| *A47C 3/025* | (2006.01) |
| *A47C 1/02* | (2006.01) |

(52) U.S. Cl.

CPC ..... *A47C 1/034* (2013.01); *A47C 1/0242* (2013.01); *A47C 1/02* (2013.01); *A47C 1/0345* (2013.01); *A47C 1/0355* (2013.01); *A47C 3/0255* (2013.01); *A61G 5/14* (2013.01)

(58) Field of Classification Search

CPC ... A47C 1/0355; A47C 1/0345; A47C 3/0255; A47C 1/02; A61G 5/14

USPC ..... 297/85 M, 85 R, 84

See application file for complete search history.

(56) References Cited

U.S. PATENT DOCUMENTS

| | | | | |
|---|---|---|---|---|
| 8,360,515 | B2 * | 1/2013 | Crum | A47C 7/50 297/85 R |
| 2001/0048239 | A1 * | 12/2001 | Kogure | B60N 2/62 297/423.2 |
| 2003/0047973 | A1 * | 3/2003 | Pellerin | A61G 5/14 297/260.2 |
| 2011/0248535 | A1 * | 10/2011 | Lapointe | A47C 1/0355 297/260.2 |

(Continued)

OTHER PUBLICATIONS

International Search Report with Written Opinion dated Dec. 23, 2016 in International Application No. PCT/US2016/057100, 7 pages.

(Continued)

*Primary Examiner* — Syed A Islam

(74) *Attorney, Agent, or Firm* — Shook, Hardy & Bacon L.L.P.

(57) ABSTRACT

A linkage mechanism provides motion capabilities for various chair types. For example, a linkage mechanism includes a combination of links that facilitate ottoman extension/closing and backrest recline/incline. In addition, a linkage mechanism includes a compact design that is usable with hi-leg style chairs having a relatively low seat height. A seating unit with a motorized linkage mechanism is also provided.

20 Claims, 12 Drawing Sheets

(56) References Cited

U.S. PATENT DOCUMENTS

| | | | | |
|---|---|---|---|---|
| 2012/0146364 | A1* | 6/2012 | Hoffman | A47C 1/03266 297/84 |
| 2012/0299363 | A1* | 11/2012 | Crum | A47C 1/0355 297/85 M |
| 2015/0272329 | A1* | 10/2015 | Lawson | A47C 1/03294 297/342 |

OTHER PUBLICATIONS

International Search Report with Written Opinion dated Dec. 1, 2014 in Application No. PCT/US2014/037686, 9 pages.
International Preliminary Report on Patentability dated Nov. 19, 2015 in Application No. PCT/US2014/037686, 6 pages.

* cited by examiner

MOTORIZED LINKAGE MECHANISM FOR HI-LEG SEATING UNIT

CROSS-REFERENCE TO RELATED APPLICATIONS

This Non-Provisional patent application is a continuation-in-part and claims priority to U.S. Non-Provisional patent application Ser. No. 14/771,404, filed on Aug. 28, 2015, and titled "LINKAGE MECHANISM FOR HI-LEG SEATING UNIT," which claims priority to PCT Application No. PCT/US2014/037686, filed on May 12, 2014, and titled "LINKAGE MECHANISM FOR HI-LEG SEATING UNIT," which claims priority to U.S. Provisional Application No. 61/991,171, filed on May 9, 2014 and titled "LINKAGE MECHANISM FOR HI-LEG SEATING UNIT," and U.S. Provisional Application No. 61/822,075, filed on May 10, 2013, and titled "LINKAGE MECHANISM FOR HI-LEG SEATING UNIT." The contents of these referenced applications are incorporated herein in their entirety.

BACKGROUND

The present invention relates broadly to motion upholstery furniture designed to support a user's body in an essentially seated disposition. Motion upholstery furniture includes recliners, incliners, sofas, love seats, sectionals, theater seating, traditional chairs, and chairs with a moveable seat portion, such furniture pieces being referred to herein generally as "seating units." More particularly, the present invention relates to an improved linkage mechanism developed to accommodate a wide variety of styling for a seating unit, which is otherwise limited by the configurations of linkage mechanisms in the field. Additionally, the improved linkage mechanism of the present invention provides for reclining a seating unit that includes a high-leg design and that includes a relatively low seat height, and additionally, provides for a motorized linkage mechanism for automated movement of a seating unit with an ottoman drive tube assembly located between the forward and rearward ends of the seating unit.

Reclining seating units exist that allow a user to forwardly extend a footrest and to recline a backrest rearward relative to a seat. These existing seating units typically provide three basic positions (e.g., a standard, non-reclined closed position; an extended position; and a reclined position). In the closed position, the seat resides in a generally horizontal orientation and the backrest is disposed substantially upright. Additionally, if the seating unit includes one or more ottomans attached with a mechanical arrangement, the mechanical arrangement is collapsed such that the ottoman (s) are not extended. In the extended position, often referred to as a television ("TV") position, the ottoman(s) are extended forward of the seat, and the backrest remains sufficiently upright to permit comfortable television viewing by an occupant of the seating unit. In the reclined position, the backrest is pivoted rearward from the extended position into an obtuse relationship with the seat for lounging or sleeping.

Several modern seating units in the industry are adapted to provide the adjustment capability described above. However, often the adjustment mechanisms used in these seating units are not ideal to be used with a high-leg chair design having a relatively low seat height. The present invention addresses these issues, among others.

SUMMARY

Embodiments of the invention are defined by the claims below, not this summary. A high-level overview of various aspects of the invention are provided here for that reason, to provide an overview of the disclosure, and to introduce a selection of concepts that are further described below in the detailed-description section. This summary is not intended to identify key or essential features of the claimed subject matter, nor is it intended to be used as an aid in isolation to determine the scope of the claimed subject matter. The scope of the invention is defined by the claims.

Generally, embodiments of the present invention seek to provide a simplified, compact linkage mechanism that can be adapted to essentially any type of seating unit, such as a high-leg style formal chair. In operation, the linkage mechanism is adapted to move between a closed position, an extended position, and a reclined position, and may be configured for motorized operation, with multiple crossbars for added stability and functionality, and an ottoman drive tube assembly positioned towards the center of the linkage mechanism that allows for vertically compact, stable extension of an ottoman footrest when a motor is activated.

Further embodiments of the present invention provide a motorized linkage mechanism for an adjustable seating unit. The motorized linkage mechanism includes a pair of seat mounting plates joined together by a back crossbar and by an ottoman crossbar. An ottoman drive tube assembly is coupled between the pair of seat mounting plates between the back crossbar and the ottoman crossbar. The drive tube assembly is rotatably coupled to a motorized drive mechanism which is attached to the back crossbar. Additionally, the drive tube is coupled to one or more linkages that are coupled to the ottoman crossbar and to a footrest assembly. Accordingly, when the drive tube is rotated through movement of the motorized drive mechanism, the linkages translate rotationally to extend the footrest assembly outward.

BRIEF DESCRIPTION OF THE DRAWINGS

Illustrative embodiments of the present invention are described in detail below with reference to the attached drawing figures, which are incorporated herein by reference, wherein.

DETAILED DESCRIPTION

The subject matter of embodiments of the present invention is described with specificity herein to meet statutory requirements. But the description itself is not intended to necessarily limit the scope of the claims. Rather, the claimed subject matter might be embodied in other ways to include different elements or combinations of elements similar to the ones described in this document, and in conjunction with other present or future technologies.

Figure 1:
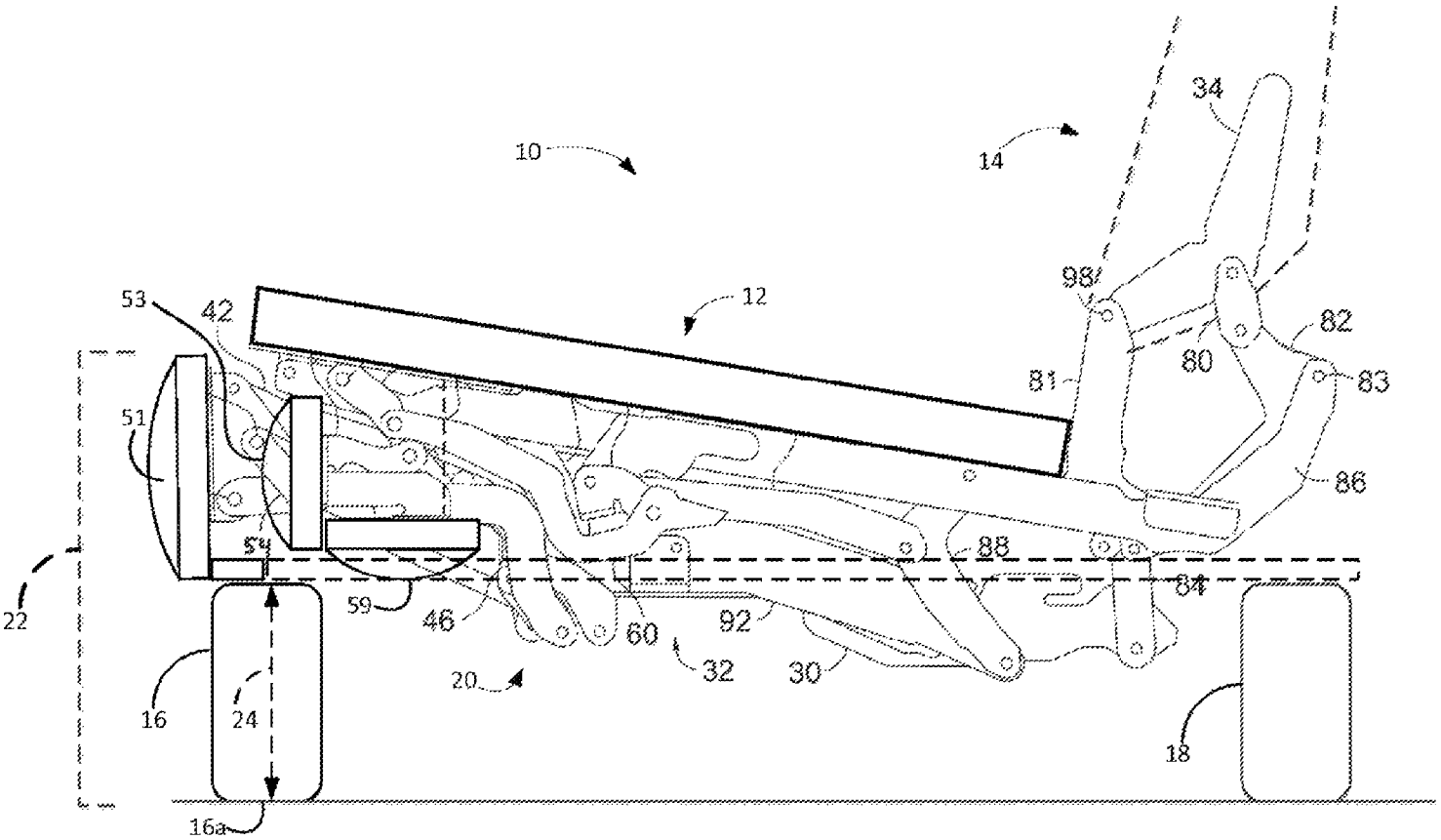
FIG. 1 depicts a side view of a linkage mechanism in a closed position and installed in a seating unit, in accordance with an embodiment of the present invention.

Referring to FIG. 1, in accordance with an embodiment of the present invention, a seating unit 10 has a seat 12, a backrest 14, legs 16 and 18, and a linkage mechanism 20, which is positioned below the seat 12 and is shown in greater detail in FIGS. 2-4. In addition, the seating unit 10 might include one or more arms (not shown) and might be incorporated into a larger seating unit, such as a sofa or a modular seating unit.

In the context of a pivot-over-arm (POA) style chair, an arm would be interconnected with the seat and linkage mechanism 20, such that the legs 16 and 18 would not directly support the arm. The legs 16 and 18 support an underlying frame of the seating unit 10, such that the seat 12 is movable together with the arm. In a POA configuration, the backrest 14 might include a wing portion that extends above the armrest and that pivots around the rear portion of the armrest when the backrest reclines. In an alternative configuration, known as a frame-within-a-frame style, the arm is stationary with respect to the seat 12, which is adjustable via the linkage mechanism. In this embodiment, the seat 12 is moveable during adjustment of the seating unit 10, but the arm remains relatively stationary.

In one embodiment, the backrest 14 extends from a rearward section of the seating unit 10 and is rotatably coupled to the linkage mechanism 20. In addition, as will be described in further detail with respect to FIGS. 2-4, the linkage mechanism 20 includes a footrest assembly, which extends and retracts one or more ottomans. In embodiments, the linkage mechanism 20 is arranged to articulably actuate and control movement of the seat 12, the backrest 14, and the ottomans between closed (collapsed), extended, and reclined positions.

In an embodiment of the present invention, the seating unit 10 includes a high-leg design having certain dimensional features. For example, FIG. 1 depicts a first dimension 22 including a distance between a portion of a seat mounting plate of the linkage mechanism 20 and a bottom end of a front leg 16 when the linkage mechanism 20 is in a closed or collapsed position. In one embodiment, the first dimension is in a range of about 11 inches to about 12.5 inches. FIG. 1 depicts a second dimension 24 including a height of the leg 16. In an embodiment of the invention, the second dimension 24 is in a range of about 5 inches to about 6 inches. Other dimensions of the present invention are described in other portions of this application, such as a distance between the seat mounting plate and a flipper ottoman bracket when the linkage mechanism is collapsed.

Absent the present invention, a high-leg chair that includes adjustment functionality of the present invention (e.g., footrest extension/collapse and backrest recline/incline) does not typically satisfy the first dimension 22 and the second dimension 24. For example, absent the present invention, it is challenging to have sufficient clearance above a ground surface to extend and collapse a footrest when the height of the seat mounting plate includes the first dimension. However, the present invention includes a linkage mechanism having a compact design, which allows for the seat mounting plate to be positioned low enough to satisfy the first dimension and for movement of the seating unit between the closed, extended, and reclined positions.

Figure 2:
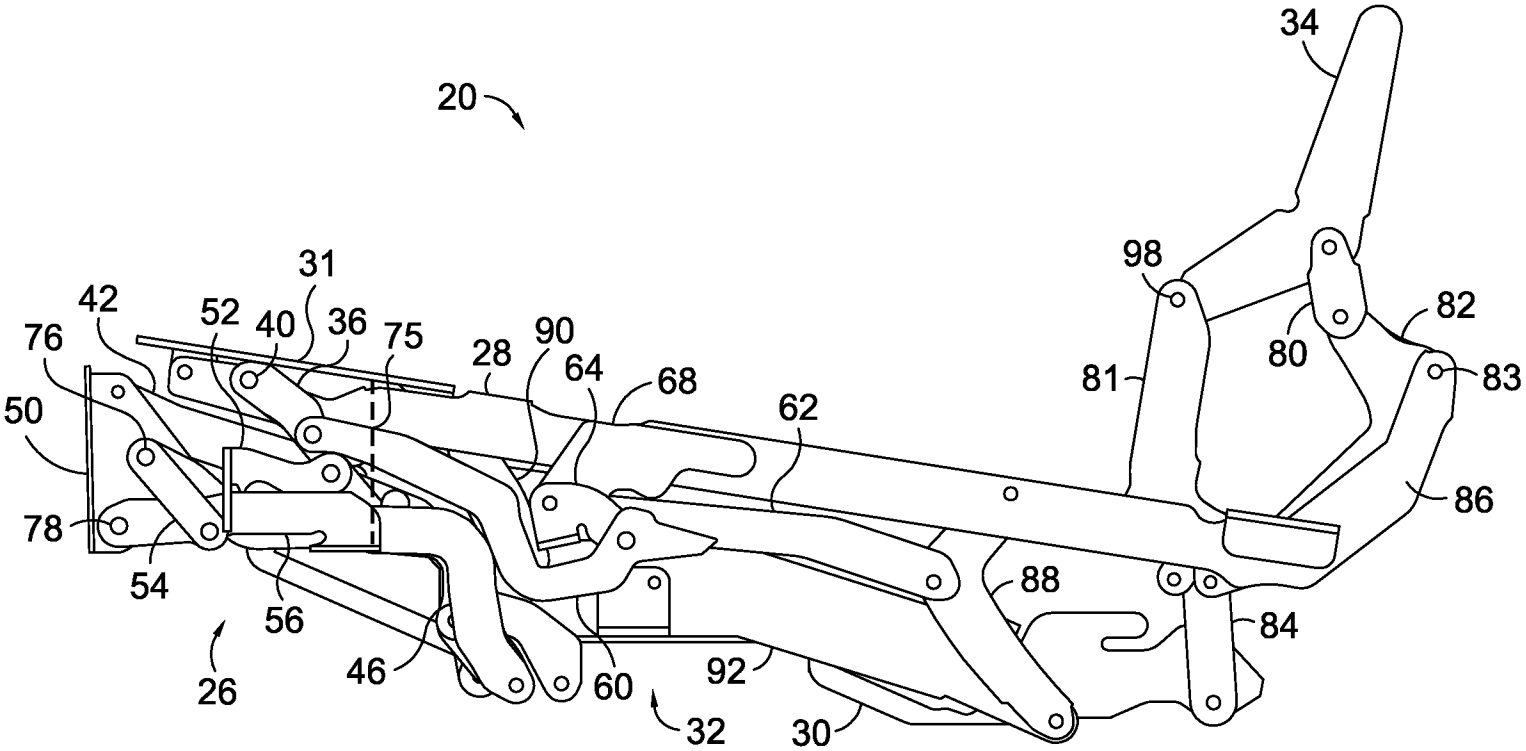
FIG. 2 depicts a side view of a linkage mechanism in a closed position, in accordance with an embodiment of the present invention.
Figure 3:
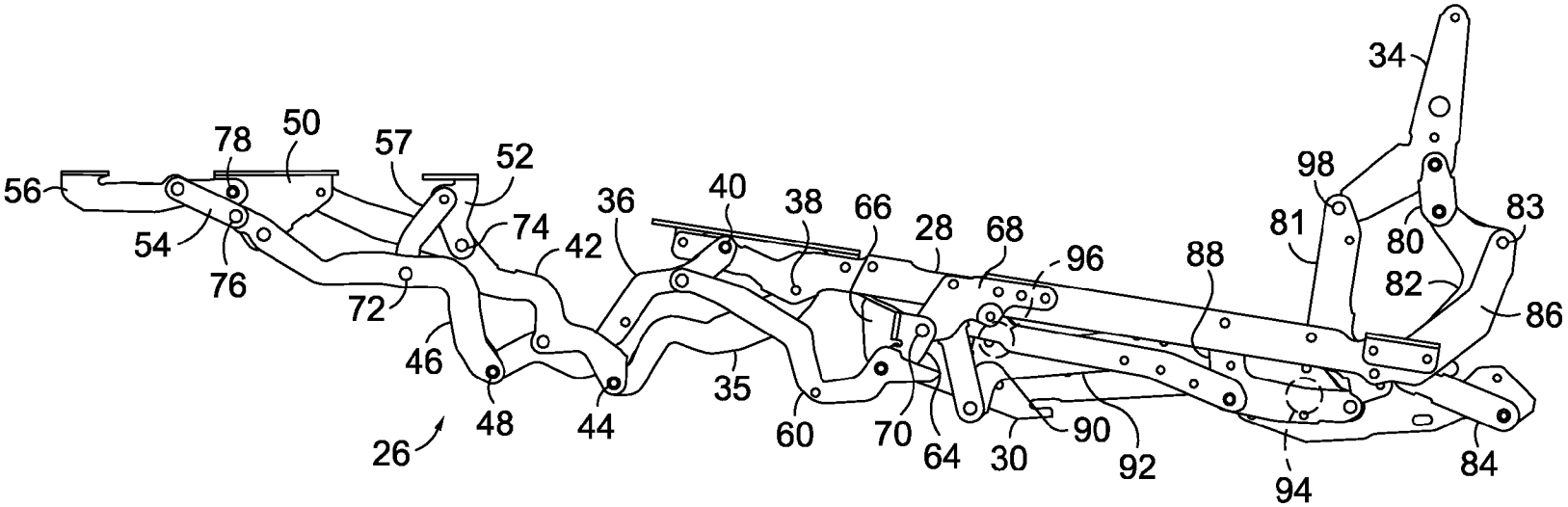
FIG. 3 depicts a side view of a linkage mechanism in an extended position, in accordance with an embodiment of the present invention.
Figure 4:
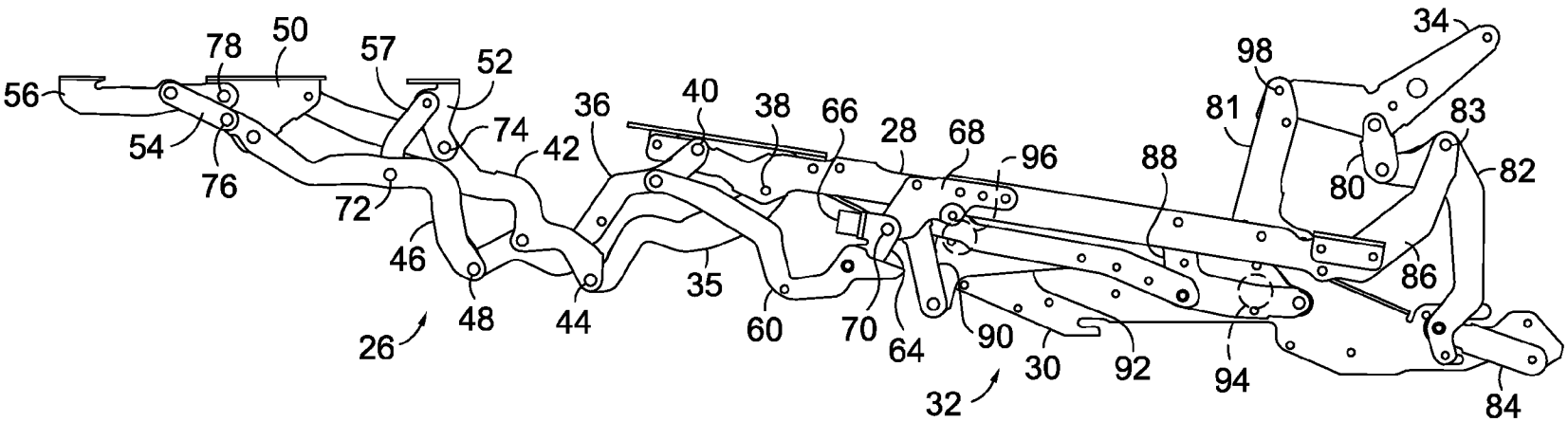
FIG. 4 depicts a side view of a linkage mechanism in a reclined position, in accordance with an embodiment of the present invention.

FIGS. 2-4 illustrate a configuration of the linkage mechanism 20 for a manually or automatically adjustable, three-position recliner seating unit (hereinafter the "seating unit") that, in embodiments, is designed to be configured as a high-leg style seating unit. As discussed above, the linkage mechanism 20 is arranged to articulably actuate and control movement of a seat, a backrest, and ottoman(s) of the seating unit. That is, the linkage mechanism 20 is adjustable to a closed position (FIG. 2), an extended (TV) position (FIG. 3), and a reclined position (FIG. 4). In the reclined position, as mentioned above, the backrest is rotated rearward and biased in a rearward inclination angle, which is an obtuse angle in relation to the seat.

During adjustment between the closed, extended, and reclined positions, the linkage mechanism 20 employs various links and pivots. The geometry of the links, as well as the locations of their interconnections, enable the advantages of a three-position, hi-leg seating unit having a relatively low seat height. Again, a relatively low seat height is defined, at least in part, by a first dimension 22 in which a distance between an end 16*a* of the leg 16 and the seat mounting plate is in a range of about 11 inches to about 12.5 inches. When this first dimension is satisfied, a finished seat height (i.e., including a seat cushion) of about 17 inches to about 18.5 inches is achievable with the linkage mechanism 20.

Generally, the linkage mechanism 20 comprises a plurality of linkages that are arranged to actuate and control movement of the seating unit during movement between the closed, the extended, and the reclined positions. Typically, in order to accomplish articulated actuation of the linkage mechanism 20, the linkages may be pivotably coupled to one or more other linkages or plates comprising the linkage mechanism 20. It is understood and appreciated that the pivotable couplings (illustrated as pivot points in the figures) between these linkages can take a variety of configurations, such as pivot pins, bearings, traditional mounting hardware, rivets, bolt and nut combinations, or any other suitable fasteners which are well-known in the furniture-manufacturing industry. Further, the shapes of the linkages and the brackets may vary, as may the locations of certain pivot points. It will be understood that when a linkage or other component is referred to as being pivotably, rotatably, or fixedly "coupled" to, "interconnected" with, "attached", etc., to another element (e.g., linkage, bracket, frame, and the like), it is contemplated that the linkage and/or elements may be in direct contact with each other, or in contact through other elements, such as intervening elements, which may also be present.

In operation, the linkage mechanism 20 guides the rotational movement of the backrest, the seat, and the ottoman (s). In an exemplary configuration, these movements are controlled by a pair of essentially mirror-image linkage mechanisms (one of which is shown herein and indicated by reference numeral 20, and later, by reference numeral 100), which comprise an arrangement of pivotably or rotatably interconnected linkages. The linkage mechanisms are disposed in opposing-facing relation about a longitudinally-extending plane that bisects the seating unit between the pair of opposed arms. As such, the ensuing discussion will focus on only one of the linkage mechanisms 20, and in later sections, the motorized linkage mechanism 100, with the content being equally applied to the other respective and complimentary linkage assembly of each respective mechanism 20 and 100.

With reference to FIGS. 2-4, diagrammatic lateral views of the linkage mechanism 20, from a vantage point internal to the seating unit, are shown, in accordance with embodiments of the present invention. In one embodiment, the linkage mechanism 20 includes the footrest assembly 26, the seat-mounting plate 28, the base plate 30, and the seat-adjustment assembly 32. Footrest assembly 26 is comprised of a plurality of links arranged to extend and collapse the ottoman(s) during adjustment of the seating unit between the extended position and the closed position, respectively. Seat-mounting plate 28 is configured to fixedly mount to the seat and, in conjunction with an opposed seat-mounting plate, define a seat support surface (not shown). Seat-adjustment assembly 32 includes the back-mounting bracket 34 and a plurality of other links. Generally, the seat-adjustment assembly 32 is adapted to recline and incline the backrest, which is coupled to the back-mounting bracket 34. In addition, the seat-adjustment assembly 32 is adapted to laterally translate and angularly adjust the seat, which is coupled to the seat-mounting plate 28. Further, the seat-adjustment assembly 32 may be coupled to a motorized drive mechanism having a linear actuator, thereby facilitating movement of the linkage mechanism 20 in response to user-initiated actuation.

In embodiments, one or more legs 16 and 18 are adapted to vertically raise and support the seating unit above an underlying surface. In embodiments, the leg(s) are mounted to arms in the frame-within-a-frame style chair, while the leg(s) are mounted to an underlying arm base in the pivot-over-arm style chair. Sometimes, a chassis is mounted to either the arm or to the underlying arm base. The base plate 30 is mounted to tube(s) (e.g., both front and rear) spanning the chassis. The seat-mounting plate 28 is interconnected to the base plate 30 via links comprising the seat-adjustment assembly 32, which translate the seat over the base plate 30 during adjustment between the closed, extended, and reclined positions while incrementally adjusting the angle of inclination therebetween.

With reference to FIGS. 2-4, the footrest assembly 26 will be described in greater detail. The footrest assembly 26 includes a rear ottoman link 35, and a front ottoman link 36, both of which attach to the seat mounting plate at pivots 38 and 40, respectively. The footrest assembly 26 further comprises a main ottoman link 42, which attaches to the rear ottoman link 35 at pivot 44 and a second ottoman link 46, which attaches to the front ottoman link 36 at pivot 48. The second ottoman link 46 and the main ottoman link 42 are both attached to the footrest bracket 50, and the main ottoman link 42 is also attached to the mid-ottoman bracket 52. The footrest bracket functions to support a footrest 51 (FIG. 1), and the mid-ottoman bracket 52 functions to support another ottoman 53 (FIG. 1) in addition to the footrest 51. A mid-ottoman control link 57 is attached from the second ottoman link 46 to the mid-ottoman bracket 52. The footrest assembly 26 further comprises a flipper control link 54 that is attached to the second ottoman link 46 and to a flipper ottoman bracket 56, which is usable to support another footrest 59 (FIG. 1).

As indicated above, the footrest assembly 26 functions to actuate and move the plurality of footrests/ottomans 51, 53, and 59 from a closed or collapsed position (FIGS. 1 and 2) to an extended position (FIG. 3). As such, the linkage mechanism 20 further comprises a lock link 60, which is attached to the front ottoman link 36, and a footrest drive link 62, which is attached to the rear ottoman link 35. The lock link 60 is further attached to a lock bracket 64, which attaches to a drive tube 66 and a lock mounting plate 68. When the drive tube 66 is activated (either manually or using a motor), the lock bracket 64 is rotated clockwise (in the view provided by FIG. 2) around the pivot 70 attaching the lock bracket 64 to the lock mounting plate 68. This motion of the lock bracket 64 drives the lock link 60 forward, which in turn causes the front ottoman link 36 to rotate clockwise on pivot 40, which attaches the front ottoman link 36 to the seat mounting plate 28. At the same time, footrest drive link 62 and rear ottoman link 35 are activated, in which case rear ottoman link 35 rotates clockwise on pivot 38, which attaches the rear ottoman link 35 to the seat mounting plate 28.

The clockwise rotation of the rear ottoman link 35 and the front ottoman link 36 from the closed position of FIG. 2 in turn causes the main ottoman link 42 and the second ottoman link 46 to rotate counterclockwise as they extend to the extended configuration of FIG. 3. In addition, the mid-ottoman control link 57 and the mid-ottoman bracket 52 rotate clockwise on pivots 72 and 74, respectively to move from the closed position (FIG. 2) to the extended position (FIG. 3). Further, the flipper control link 54 and the flipper ottoman bracket 56 rotate clockwise on pivots 76 and 78, respectively, to move from the closed position (FIG. 2) to the open position (FIG. 3).

As indicated previously, the compact design of the linkage mechanism 20 allows for the footrest assembly 26 to move from the closed position to the extended position when the seating unit includes the first dimension 22 and the second dimension 24 (FIG. 1). The compact design is a function of the various geometries of the links included in the footrest assembly, such as the shape and spacing of linkages, lengths of linkages, distances between pivots, and the like. In one embodiment, those features are as depicted in FIGS. 2-4.

The compact design of the linkage mechanism 20 provides other benefits as well. For example, in one embodiment, the design allows a flipper-ottoman board (not shown) mounted to the flipper-ottoman bracket 56 to extend to the near width of the main-footrest board (not shown). Absent this technology, the flipper-ottoman board is reduced and is not able to extend as wide (from left to right). In another embodiment, the design satisfies a third dimension 75 defined by a distance between a seat mounting flange 31 and a mounting surface of the flipper-ottoman bracket 56 when the assembly is in a closed position. In one embodiment, the third dimension is about 3.625 inches.

Movement of the footrests/ottomans 51, 53, and 59 and the footrest assembly 26 from a closed arrangement to an extended position has been described. Collapsing or closing these elements is facilitated by moving the drive tube 66 in an opposite direction (i.e., counterclockwise direction in FIG. 3), which in turn causes a reverse of the above described movements.

With continued reference to FIGS. 2-4, the seat-adjustment assembly 32 will now be described in more detail. As indicated previously, the seat-adjustment assembly 32 attaches the seat mounting plate 28 to the base plate 30. Also, the seat-adjustment assembly 32 traverses the seat mounting plate 28 forward when the backrest 14 is moved into a more reclined position and traverses the seat mounting plate 28 rearward as the backrest 14 is moved into a more inclined position.

The seat-adjustment assembly 32 includes a back drive link 80, rear bellcrank 82, and back toggle link 84. The back drive link 80 attaches to the back-mounting bracket 34 and to the rear bellcrank 82. The mounting bracket 34 attaches to a rear seat bracket 81 extending from the seat mounting plate 28. The rear bellcrank 82 is attached at pivot 83 to a rear portion 86 of the seat mounting plate 28 and to the back toggle link 84, which attaches to the base plate 30.

The seat-adjustment assembly 32 further comprises a rear pivot link 88 and a front pivot link 90, both of which attach to a roller link 92. The roller link 92 includes two rollers 94 and 96, which are rotatably coupled to the roller link 92. The rollers 94 and 96 are positioned between the roller link 92 and the base plate 30 and the rollers 94 and 96 are positioned on one or more tracks of the base plate 30.

As previously indicated, the seat-adjustment assembly 32 facilitates recline and incline of the backrest 14 and traverses the seat mounting plate 28 with respect to the base plate 30. The operation of the seat-adjustment assembly 32 will now be described in more detail.

Referring to FIG. 3, the seat-mounting plate 28 has been adjusted downward as a result of moving from a closed position to an extended position. At least part of the downward shift results from the footrest drive link 62 acting on the rear pivot link. That is, when the linkage mechanism moves from a closed position to an extended position, the rear pivot link rotates counterclockwise, thereby shifting the seat mounting plate downward. Moving to the reclined position, the back-mounting bracket 34 is rotated clockwise on pivot 98, which attaches the back-mounting bracket 34 to the rear seat bracket 81. For example, back-mounting bracket 34 might be rotated clockwise when a user seated in the seating unit 10 leans backward or otherwise applies weight to the backrest 14. Rotation of the back mounting bracket 34 clockwise pushes the back drive link 80 downward, thereby causing the rear bellcrank 82 to rotate counterclockwise on pivot 83 and to shift downward. The back toggle link 84 adjusts counterclockwise on the pivot attaching the back toggle link 84 to the base plate 30. When the base plate 30 is fixed relative to the seat-mounting plate (such as when the base plate 30 is directly or indirectly attached to legs of a chair resting on the floor), the movement of the back mounting bracket 34, back drive link 80, rear bellcrank 82, and back toggle link 84 initiates a forward motion of the seat mounting plate 28.

With continued reference to FIG. 3, as the seat mounting plate 28 is biased forward, the rear pivot link 88 and front pivot link 90 transfer the forward motion of the seat mounting plate 28 to the roller link 92. In turn, the roller link 92 shifts forward relative to the base plate 30 using the rollers 94 and 96, which traverse the track of the base plate 30.

Movement of the seat-adjustment assembly 32 from a relatively inclined position in FIG. 3 to a relatively reclined position in FIG. 4 has been described. Movement from the position depicted in FIG. 4 to the position depicted in FIG. 3 is facilitated by rotating the back-mounting bracket 34 in a counterclockwise direction (as viewed in FIG. 3), which in turn causes a reverse of the above described movements. For example, the back-mounting bracket 34 might be actively moved and/or a force that moved the back-mounting bracket 34 clockwise (e.g., user's weight) might be removed. Likewise, a user leaning forward might also apply a force that allows the back mounting bracket 34 to rotate counterclockwise.

Figure 5:
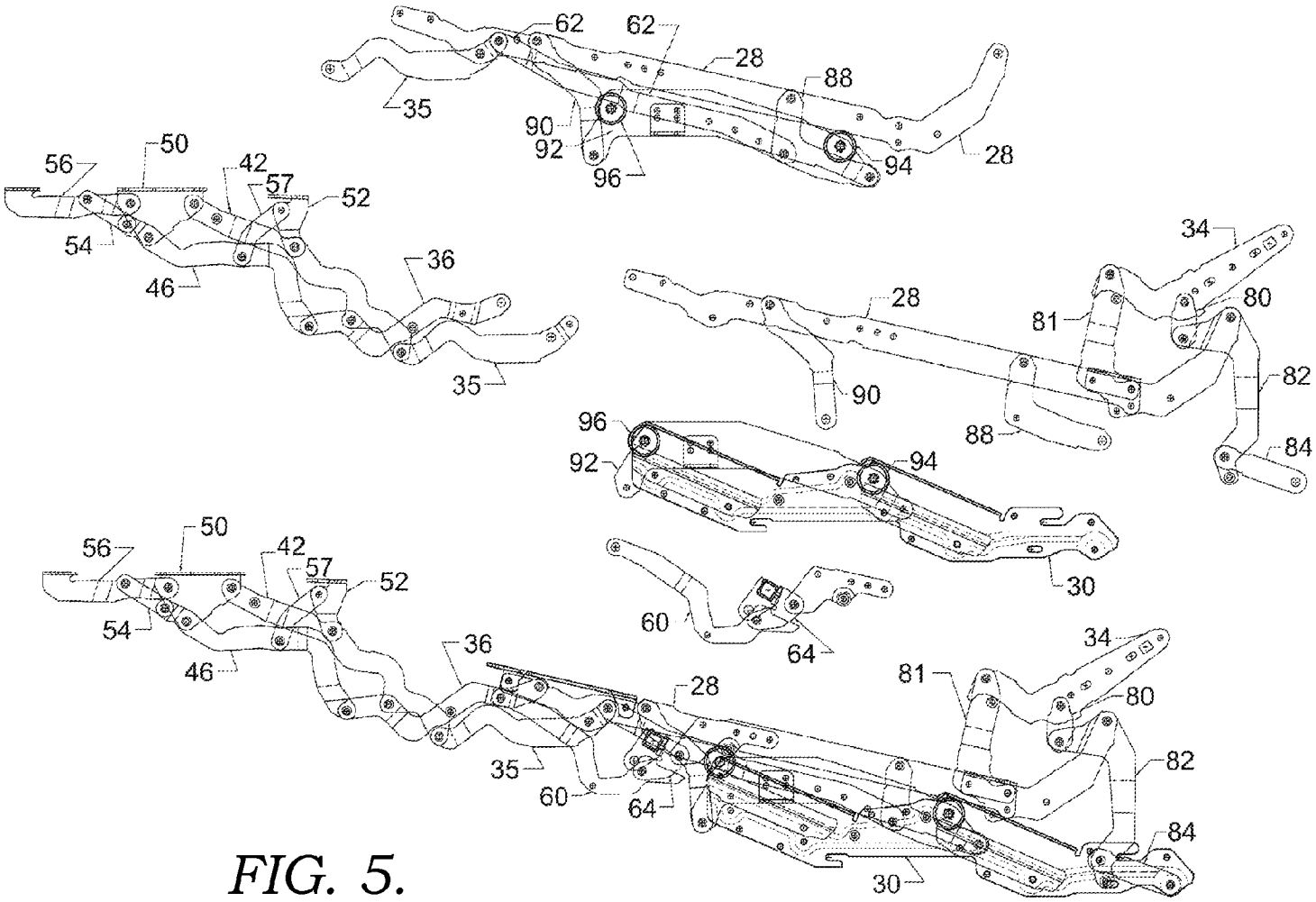
FIG. 5 depicts various views of different combinations of linkages, which are labeled, in accordance with an embodiment of the present invention.

FIG. 5 depicts various views of different combinations of linkages, which are labeled, in accordance with an embodiment of the present invention.

Referring now to FIGS. 6-11, a variety of depictions of a motorized linkage mechanism 100 for a motorized adjustable seating unit 102, with the seating unit 102 moving between a closed position 104, extended position 106, and reclined position 108, is provided, in accordance with an embodiment of the present invention. As discussed in relation to seating unit 10, the motorized linkage mechanism 100 may be one of a pair of mirror-image linkage mechanisms that are coupled together within the seating unit 102. As such, each of the components may be referenced individually, but each of the components coupled to the seating plate, other than the crossbars or drive tubes extending between the mirror-image linkage mechanisms, may be one of a pair, or rather, have a complementary component on the other linkage mechanism.

Figure 6:
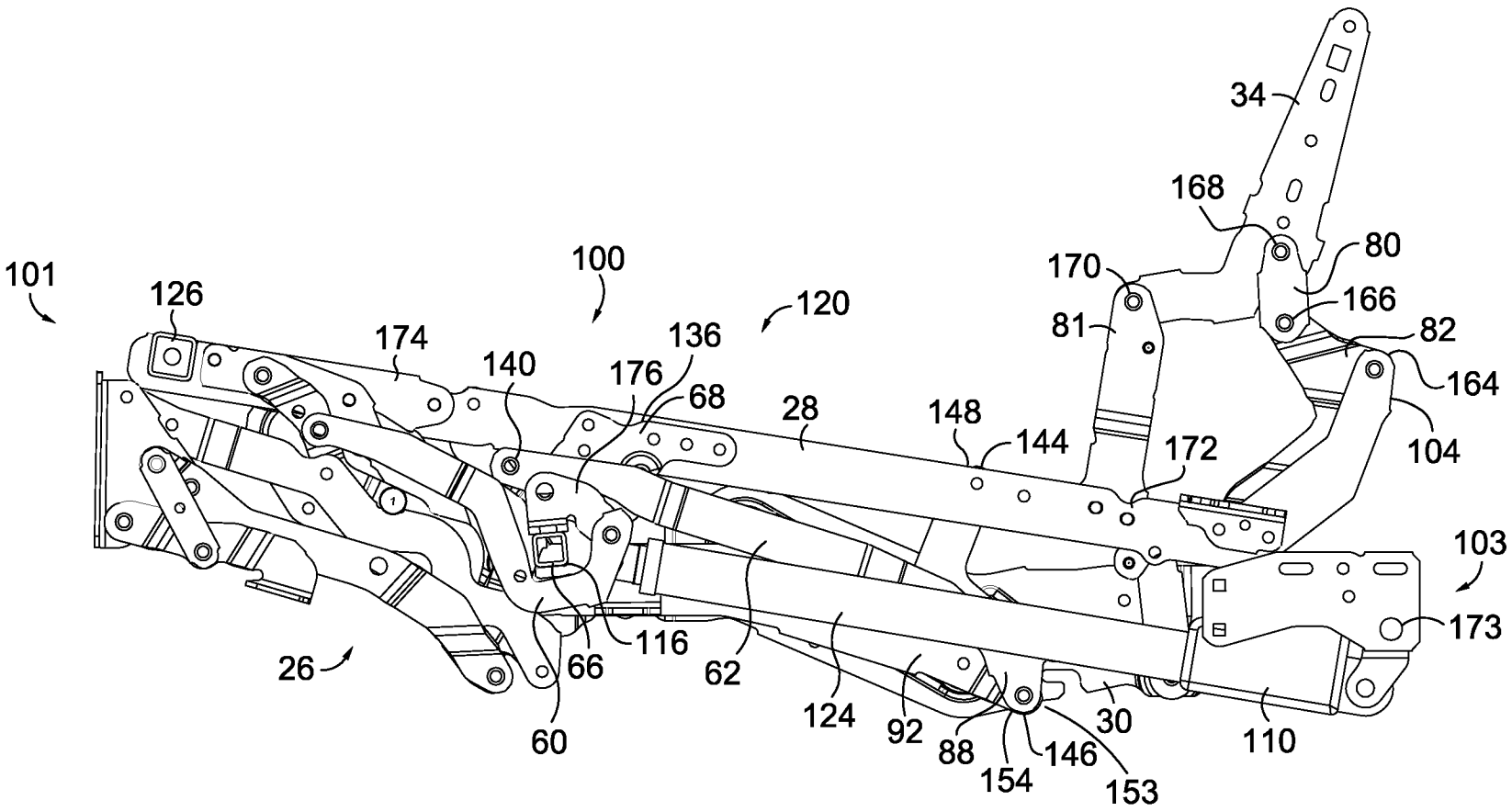
FIG. 6 depicts a side view of a motorized, adjustable linkage mechanism for a seating unit in a closed position, in accordance with an embodiment of the present invention.
Figure 7:
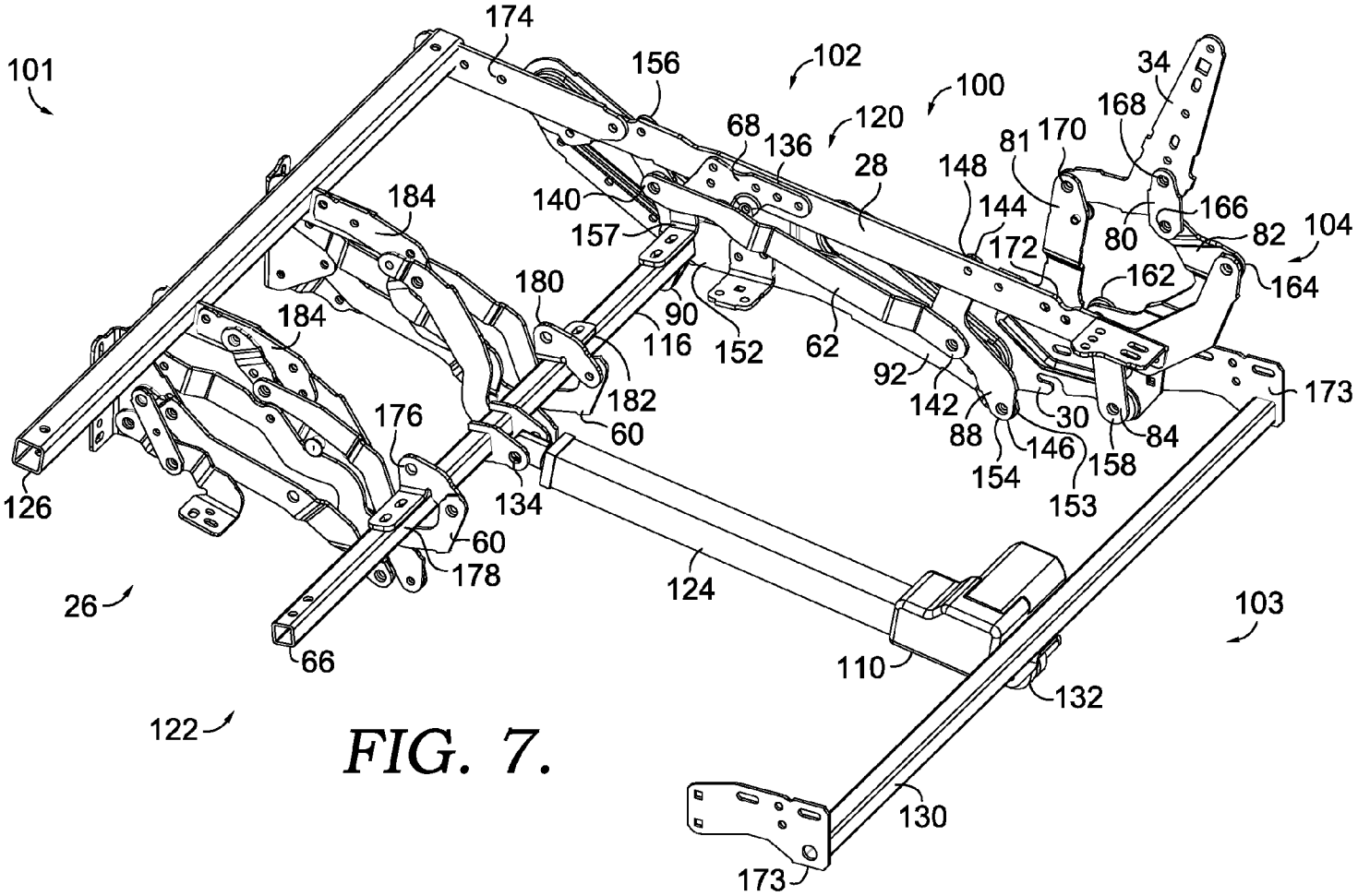
FIG. 7 depicts an angled perspective view of the motorized, adjustable linkage mechanism in FIG. 6, in accordance with an embodiment of the present invention.
Figure 8:
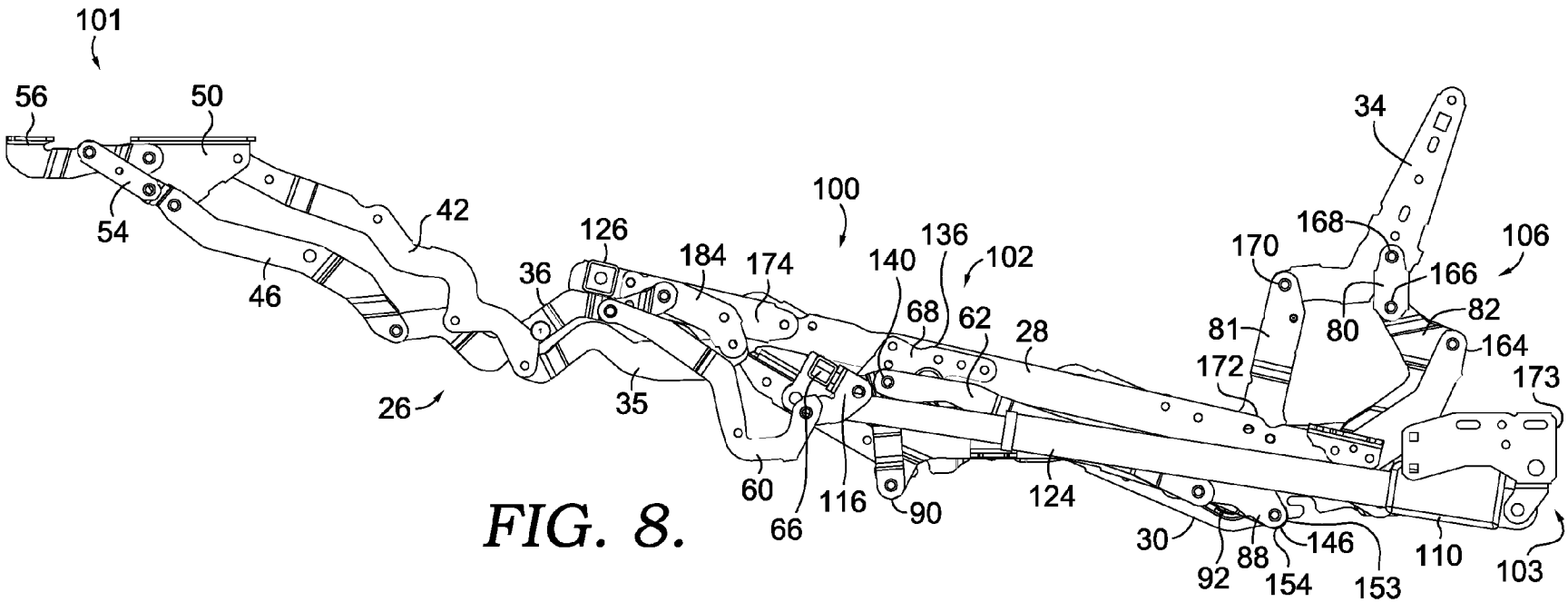
FIG. 8 depicts a side view of the motorized, adjustable linkage mechanism in FIG. 6 in an extended position, in accordance with an embodiment of the present invention.
Figure 9:
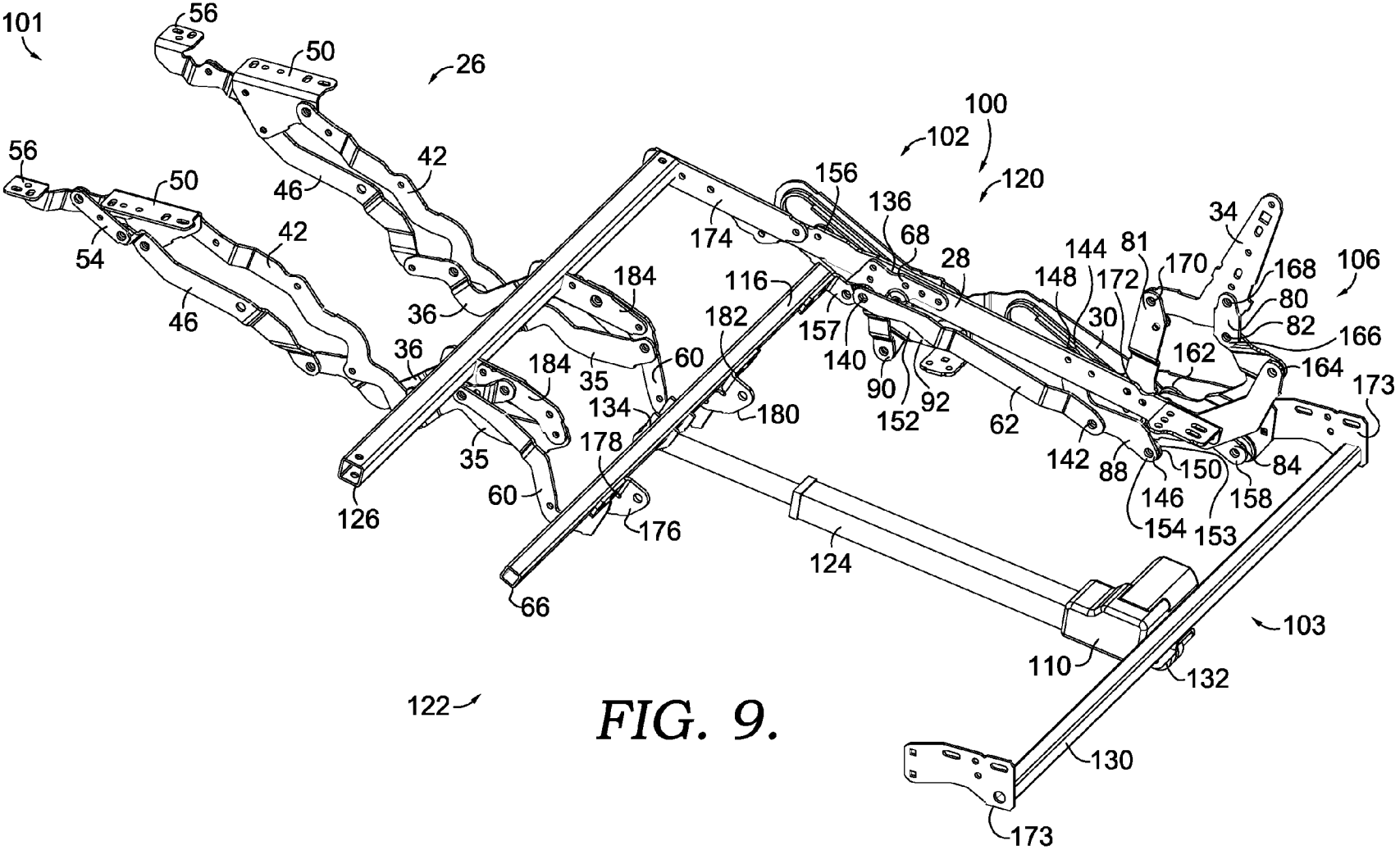
FIG. 9 depicts an angled perspective view of the motorized, adjustable linkage mechanism in FIG. 8, in accordance with an embodiment of the present invention.
Figure 10:
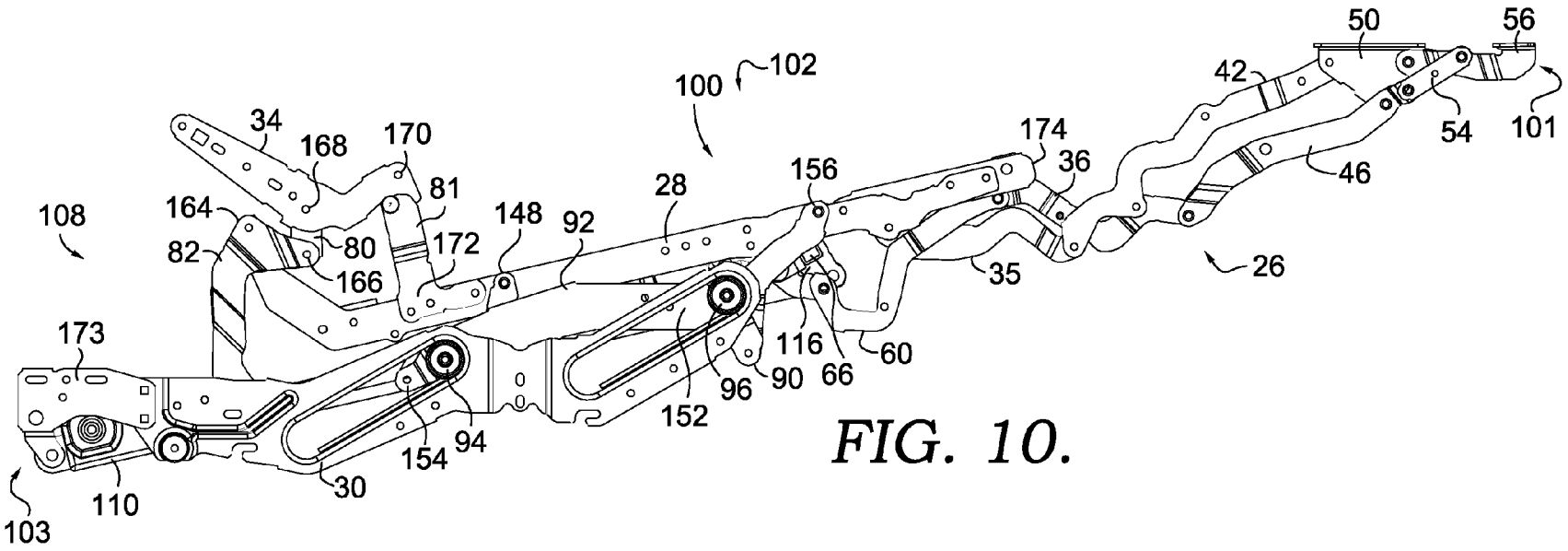
FIG. 10 depicts a side view of the motorized, adjustable linkage mechanism in FIG. 6 in a reclined position, in accordance with an embodiment of the present invention.
Figure 11:
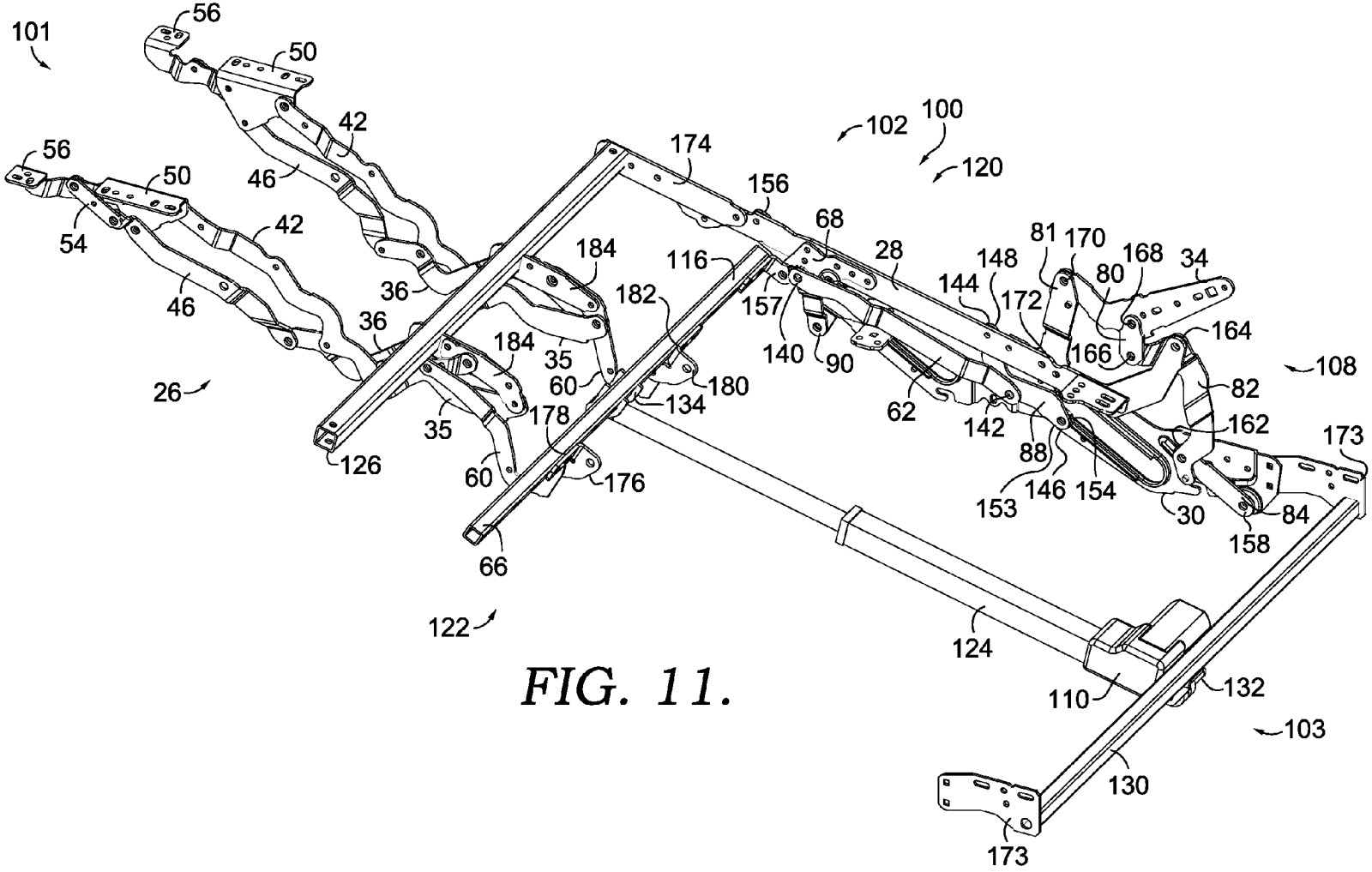
FIG. 11 depicts an angled perspective view of the motorized, adjustable linkage mechanism in FIG. 10, in accordance with an embodiment of the present invention.

FIGS. 6-7 depict the seating unit 102 in the closed position 104. FIGS. 8-9 depict the seating unit in the extended position 106. FIGS. 10-11 depict the seating unit in the reclined position 108. The movement between the positions 104, 106, and 108 may be actuated by a motorized drive mechanism 110 coupled to the seating unit 102. The seating unit includes a forward end 101 and a rearward end 103, and a first side 120 and a second side 122.

As shown in FIGS. 1-6, the seating unit 102 includes a seat mounting plate 28, the motorized drive mechanism 110, and an ottoman drive tube assembly 116. The ottoman drive tube assembly 116 includes a drive tube 66 that is rotatably coupled to the motorized drive mechanism 110 and to the seat mounting plate 28 of the motorized linkage mechanism 100 (and also, in operation, to a mirrored seat mounting plate and motorized linkage mechanism mounted opposite the seat mounting plate 28 depicted in FIGS. 1-6). The motorized drive mechanism 110 includes a linear actuator 124 that is retracted in FIG. 6-7, and at least partially extended in FIGS. 8-11. The drive tube 66 is rotatably coupled to an ottoman crossbar 126 with linkages that allow extension of a footrest assembly 26 when the drive tube 66 is rotated by extension of the linear actuator 124 which is rotatably coupled to the drive tube 66.

The ottoman crossbar 126 is positioned at the forward end 101 of the seating unit 102 and extends from the seat mounting plate 28 of the motorized linkage mechanism 100. The ottoman drive tube assembly 116 is coupled to the motorized linkage mechanism 100 between the forward end 101 and the rearward end 103 of the seating unit 102. The drive tube assembly 116 may be coupled between the seat mounting plate 28 and an opposite seat mounting plate (not shown in FIGS. 1-6) and extend at least partially between the first side 120 and the second side 122 of the seating unit 102. The motorized drive mechanism 110 is coupled to a back crossbar 130 at a first motor connection location 132 and extends to the drive tube assembly 116, to which it is coupled at a second motor connection location 134, which is pivotable relative to the drive tube 66.

The ottoman drive tube assembly 116 comprises a number of interlinked components. The seat mounting plate 28 includes a lock mounting plate 68 coupled to an inside of the motorized linkage mechanism 100 at a first location 136 between the forward end 101 and the rearward end 103 of the seating unit 102 and between the first and second sides 120, 122 of the seating unit 102. An ottoman control link 157 is rotatably coupled to the lock mounting plate 68. The ottoman control link 157 is rotatably coupled to a footrest drive link 62 having first and second ends 140, 142, where the first end 140 of the footrest drive link 62 is coupled to the ottoman control link 157. Once again, the seat mounting plates 28 shown in FIGS. 6-11 may be mirrored on an opposite side of the seating unit 102 to provide a pair of parallel, coupled, seat mounting plates 28 that provide motorized linkage mechanisms 100 that allow dynamic movement of the seating unit 102.

The first end 140 of the footrest drive link 62 is coupled to the ottoman control link 157 on an inside of the ottoman control link 157 (i.e., closer to a center of the seating unit 102; between the first and second sides 120, 122), and the lock mounting plate 68 is coupled to the ottoman control link 157 on an outside of the ottoman control link 157 (i.e., further from a center of the seating unit 102, towards the first side 120 of the seating unit). In other words, the first end 140 of the footrest drive link 62 (on both sides of the seating unit 102) is coupled such that movement of the first end 140 of the footrest drive link 62 does not interfere with other components of the ottoman drive tube assembly 116. In the mirrored configuration discussed above, the ottoman control links 157 are fixedly coupled to opposite ends of the drive tube 66. The drive tube 66 is therefore rotatably coupled to the motorized drive mechanism 110 relative to the pair of seat mounting plates 28.

Each of the footrest drive links 62 is rotatably coupled to a rear pivot link 88 at a second end 142 of the footrest drive link 62. The rear pivot link 88 is coupled to the second end 142 of the footrest drive link 62 between a first rear pivot link end 144 and a second rear pivot link end 146. The first rear pivot link end 144 is rotatably coupled to an outside of the seat mounting plate 28 at a second location 148. The second end 146 of the rear pivot link 88 is rotatably coupled to a roller link 92 at a third location 153. As shown in FIG. 10, which depicts an outside view of the first side 120 of the motorized linkage mechanism 100, the roller link 92 includes a roller link first end 152 and a roller link second end 154. The roller link 92 is slidably coupled to a base plate 30 at rollers 94 and 96 which are received in roller track locations in the base plate 30.

Furthermore, a front pivot link 90 is rotatably coupled to an outside of the seat mounting plate 28 at a fourth location 156. Additionally, the front pivot link 90 is rotatably coupled to the roller link 92 at the roller link first end 152. The roller link 92 is therefore coupled to the front pivot link 90 at the roller link first end 152 and to the rear pivot link 88 at the roller link second end 154. The base plate 30 is rotatably coupled to a back toggle link 84 at a fifth location 158. The back toggle link 84 is rotatably coupled to a rear bellcrank 82 at a sixth location 162. The rear bellcrank 82 is coupled to the seat mounting plate 28 towards a rearward end 103 of the seating unit 102 at a seventh location 164, and is also rotatably coupled to a back drive link 80 at an eighth location 166. The back drive link 80 is rotatably coupled to a back mounting bracket 34 at a ninth location 168. The back mounting bracket 34 is rotatably coupled to a rear seat bracket 81 at a tenth location 170, and the rear seat bracket 81 is fixedly coupled to the seat mounting plate 28 at an eleventh location 172.

As shown in FIGS. 6-11, the back crossbar 130 may be coupled to the base plate 30 of the seating unit 102 at the rearward end 103 with a back crossbar bracket 173, and the ottoman crossbar 126 may be coupled to the seat mounting plate 28 at the forward end 101 of the seating unit 102 with an ottoman crossbar bracket 174. The ottoman crossbar 126 and the drive tube 66 of the ottoman drive tube assembly 116 are rotatably coupled to each other with a combination of linkages. In this respect, as shown in FIGS. 7, 9, and 11, the drive tube 66 includes a first lock bracket 176 fixedly coupled to the drive tube 66 at a first drive tube location 178 and a second lock bracket 180 fixedly coupled to the drive tube 66 at a second drive tube location 182. Each of the first and second lock brackets 176, 180 is rotatably coupled to a respective lock link 60. Each of the lock links 60 are rotatably coupled to a respective front ottoman link 36. Each of the front ottoman links 36 is rotatably coupled to a respective ottoman mounting bracket 184 fixedly coupled to the ottoman crossbar 126 between the first side 120 and the second side 122 of the seating unit 102.

The footrest assembly 26 is rotatably coupled to the ottoman crossbar 126. Each of the ottoman mounting brackets 184 is further rotatably coupled to a rear ottoman link 35. Each of the rear ottoman links 35 is rotatably coupled to a respective main ottoman link 42. Each of the main ottoman links 42 is rotatably coupled to a respective footrest bracket 50. In addition to these linkages, rotatably coupled to each of the ottoman mounting brackets 184 is the respective front ottoman link 36, which is also rotatably coupled to the respective lock link 60, as discussed above, and also, is rotatably coupled to a respective second ottoman link 46. Each second ottoman link 46 is rotatably coupled to a respective flipper control link 54. Each flipper control link 54 is rotatably coupled to a respective flipper ottoman bracket 56. Each flipper ottoman bracket 56 is rotatably coupled to the respective footrest bracket 50 on each side of the footrest assembly 26.

Different configurations of the motorized linkage mechanism 100, the corresponding footrest assembly 26, and the overall seating unit 102 are possible and contemplated. The ottoman drive tube assembly 116 may be positioned at various locations between the forward and rearward ends 101, 103 of the seating unit 102. Further, the motorized drive mechanism 110 may have another coupling configuration with the ottoman drive tube assembly 116 such as, for example, being rotatably coupled to the drive tube assembly 116 through a side of the drive tube assembly 116, in order to provide rotational force from an axial position. Additionally, the distance between the drive tube 66 and the ottoman crossbar 126 may be varied, depending on the desired position of linkages, their length, and the linkage arrangement.

Additionally, more or fewer footrest components may be used. For example, more or fewer than two linkage assemblies extending out to respective footrest brackets 50 may be used. The ottoman crossbar 126 may have a first cross-sectional area, and the drive tube 66 may have a second cross-sectional area, and in this respect, the first cross-sectional area may be larger than the second cross-sectional area, as the ottoman crossbar 126 may require greater support in certain configurations.

Figure 12:
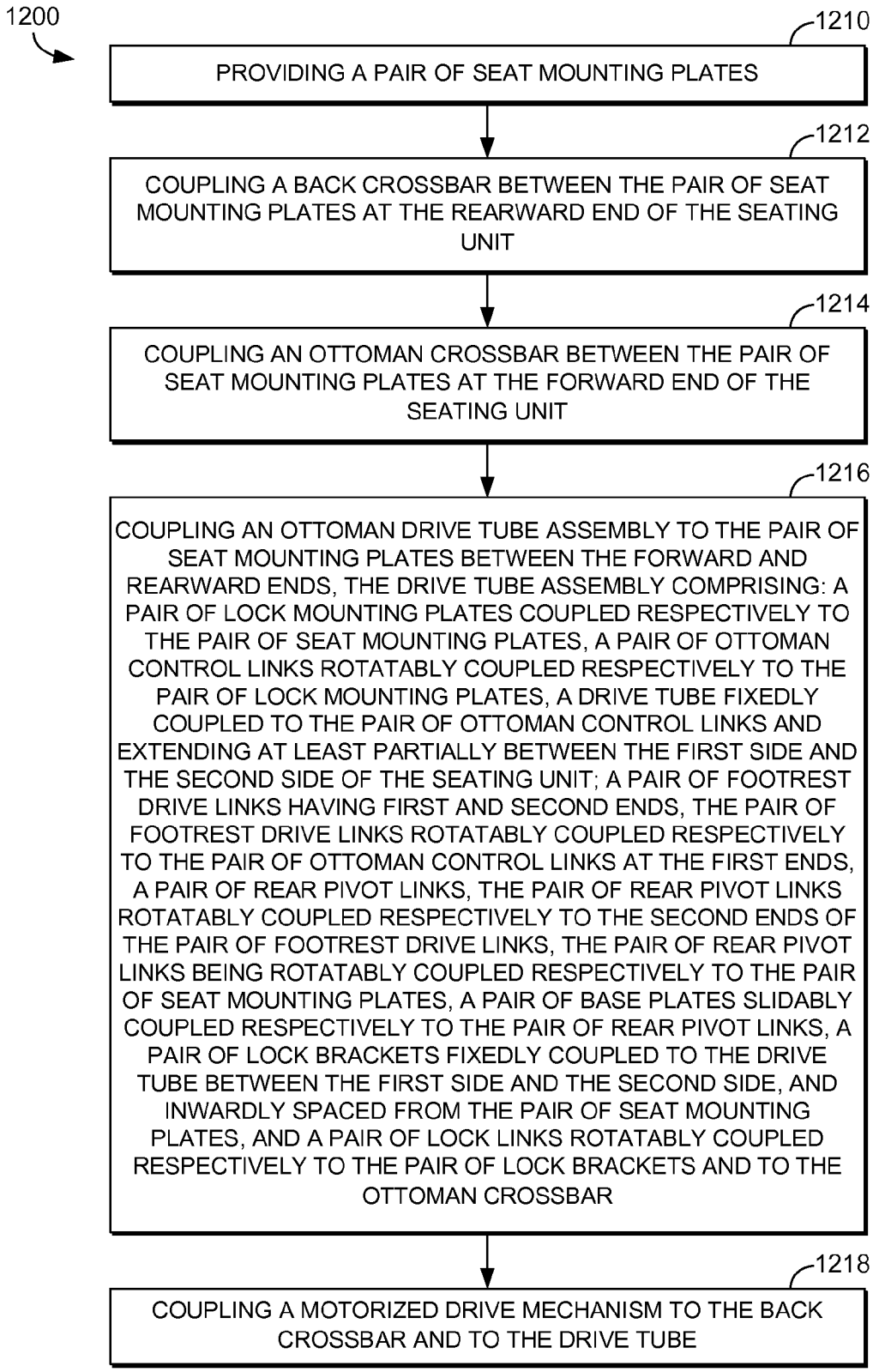
FIG. 12 depicts a block diagram of an exemplary method for assembling a motorized linkage mechanism for an adjustable seating unit, in accordance with an embodiment of the present invention.

FIG. 12 depicts a block diagram of an exemplary method 1200 for assembling a motorized linkage mechanism, such as the motorized linkage mechanism 100 shown in FIGS. 6-11, for an adjustable seating unit, such as the adjustable seating unit 102 shown in FIGS. 6-11, in accordance with an embodiment of the present invention.

At a block 1210, a pair of seat mounting plates, such as the seat mounting plate 28 shown in FIGS. 6-11 and an opposite, mirrored seat mounting plate coupled to the seating unit 102, is provided. At a block 1212, a back crossbar, such as the back crossbar 130 shown in FIGS. 6-11, is coupled between the pair of seat mounting plates at the rearward end, such as the rearward end 103 shown in FIGS. 6-11, of the seating unit. At a block 1214, an ottoman crossbar, such as the ottoman crossbar 126 shown in FIGS. 6-11, is coupled between the pair of seat mounting plates at the forward end, such as the forward end 101 shown in FIGS. 6-11, of the seating unit. At a block 1216, an ottoman drive tube assembly, such as the ottoman drive tube assembly 116 shown in FIGS. 6-11, is coupled to the pair of seat mounting plates between the forward and rearward ends of the seating unit.

In the exemplary method 1200, the drive tube assembly may comprise a pair of lock mounting plates, such as the lock mounting plate 68 shown in FIGS. 6-11 and an opposite, mirror image lock mounting plate on the seating unit 102, coupled respectively to the pair of seat mounting plates, a pair of ottoman control links, such as the ottoman control link 157 shown in FIGS. 6-11 and an opposite, mirror image ottoman control link on the seating unit 102, rotatably coupled respectively to the pair of lock mounting plates.

The drive tube assembly may further comprise a drive tube, such as the drive tube 66 shown in FIGS. 6-11, fixedly coupled to the pair of ottoman control links and extending at least partially between the first side and the second side of the seating unit, such as the first and second sides 120, 122 shown in FIGS. 6-11, a pair of footrest drive links, such as the footrest drive link 62 shown in FIGS. 6-11 and an opposite, mirror image footrest drive link on the seating unit 102, having first and second ends, such as the first and second ends 140, 142 shown in FIGS. 6-11.

Further, the drive tube assembly may further comprise the pair of footrest drive links rotatably coupled respectively to the pair of ottoman control links at the first ends, a pair of rear pivot links, such as the rear pivot link 88 shown in FIGS. 6-11 and an opposite, mirror image rear pivot link, the pair of rear pivot links rotatably coupled respectively to the second ends of the pair of footrest drive links, the pair of rear pivot links being rotatably coupled respectively to the pair of seat mounting plates. The drive tube assembly may further comprise a pair of base plates, such as the base plate 30 shown in FIGS. 6-11 and an opposite, mirror image base plate, slidably coupled respectively to the pair of rear pivot links. The drive tube assembly may further comprise a pair of lock brackets, such as the first and second lock brackets 176, 180 shown in FIG. 9, fixedly coupled to the drive tube between the first side and the second side, and inwardly spaced from the pair of seat mounting plates, and a pair of lock links, such as the lock links 60 shown in FIG. 9, rotatably coupled respectively to the pair of lock brackets and to the ottoman crossbar.

At a block 1218, the method 1200 further comprises coupling a motorized drive mechanism, such as the motorized drive mechanism 110 shown in FIGS. 6-11, to the back crossbar and to the drive tube. Additionally, the motorized drive mechanism may be pneumatic, hydraulic, or electric, and may be linearly or rotational actuated, and/or may be another configuration or design that provides rotational force to the drive tube assembly.

Many different arrangements of the various components depicted, as well as components not shown, are possible without departing from the scope of the claims below. Embodiments of our technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and sub-combinations are of utility and may be employed without reference to other features and sub-combinations and are contemplated as within the scope of the claims.

What is claimed is:

1. A motorized linkage mechanism for an adjustable seating unit having forward and rearward ends, and spaced apart first and second sides, the linkage mechanism comprising:

a pair of seat mounting plates, spaced from one another;

a back crossbar coupled between the pair of seat mounting plates at the rearward end of the seating unit;

an ottoman crossbar coupled between the pair of seat mounting plates at the forward end of the seating unit;

an ottoman drive tube assembly coupled between the pair of seat mounting plates between the forward and rearward ends, the drive tube assembly comprising:

a pair of lock mounting plates coupled respectively to the pair of seat mounting plates, a pair of ottoman control links rotatably coupled respectively to the pair of lock mounting plates, a drive tube fixedly coupled to the pair of ottoman control links and extending at least partially between the first side and the second side of the seating unit;

a pair of footrest drive links having first and second ends, the pair of footrest drive links rotatably coupled respectively to the pair of ottoman control links at the first ends, a pair of rear pivot links, the pair of rear pivot links rotatably coupled respectively to the second ends of the pair of footrest drive links, the pair of rear pivot links being rotatably coupled respectively to the pair of seat mounting plates;

a pair of base plates slidably coupled respectively to the pair of rear pivot links, and at least one lock bracket fixedly coupled to the drive tube between the first side and the second side, and inwardly spaced from the pair of seat mounting plates, at least one lock link coupled to the at least one lock bracket, the at least one lock link rotatably coupled to the ottoman crossbar; and a motorized drive mechanism coupled to the back crossbar and to the drive tube.

2. The linkage mechanism of claim 1, wherein the motorized drive mechanism includes a linear actuator.

3. The linkage mechanism of claim 1, further comprising:

a pair of roller links rotatably coupled to the pair of rear pivot links, respectively, the pair of roller links coupled to the pair of seat mounting plates, respectively, and the pair of roller links slidably coupled to the pair of base plates, respectively.

4. The linkage mechanism of claim 3, further comprising a pair of front pivot links that are rotatably coupled to the pair of seat mounting plates, respectively, and to the pair of roller links, respectively.

5. The linkage mechanism of claim 4, further comprising:

a pair of rear bellcranks that are coupled to the pair of seat mounting plates, respectively; and a pair of back toggle links which are rotatably coupled to the pair of base plates, respectively, and to the pair of rear bellcranks, respectively.

6. The linkage mechanism of claim 5, further comprising:

a pair of rear seat brackets coupled to the pair of seat mounting plates, respectively;

a pair of back mounting brackets rotatably coupled to the pair of rear seat brackets, respectively; and a pair of back drive links that are rotatably coupled to the pair of back mounting brackets, respectively, and to the pair of rear bellcranks, respectively.

7. The linkage mechanism of claim 6, wherein each of the pair of roller links further comprises a first roller slidably coupled to the respective base plate at a first track location and a second roller slidably coupled to the respective base plate at a second track location.

8. The linkage mechanism of claim 1, wherein the at least one lock bracket comprises:

a first lock bracket coupled to the drive tube at a first drive tube location between the first side and the second side, and a second lock bracket coupled to the drive tube at a second drive tube location between the first side and the second side.

9. The linkage mechanism of claim 8, wherein the motorized drive mechanism further comprises a linear actuator, and wherein the motorized drive mechanism is coupled to the back crossbar at a first motor connection location and to the drive tube at a second motor connection location, wherein the second motor connection location is between the first drive tube location and the second drive tube location.

10. The linkage mechanism of claim 1, further comprising at least one front ottoman link rotatably coupled to the at least one lock link, wherein each of the at least one front ottoman link is rotatably coupled to the ottoman crossbar.

11. A linkage mechanism for an adjustable seating unit having forward and rearward ends, and spaced apart first and second sides, the linkage mechanism comprising:

an ottoman drive tube assembly coupled between a pair of seat mounting plates between the forward and rearward ends, the drive tube assembly comprising:

a pair of lock mounting plates coupled respectively to the pair of seat mounting plates;

a pair of ottoman control links rotatably coupled respectively to the pair of lock mounting plates;

a drive tube fixedly coupled to the pair of ottoman control links and extending at least partially between the first side and the second side of the seating unit;

a pair of footrest drive links having first and second ends, the pair of footrest drive links rotatably coupled respectively to the pair of ottoman control links at the first ends;

a pair of rear pivot links, the pair of rear pivot links rotatably coupled respectively to the second ends of the pair of footrest drive links, the pair of rear pivot links being rotatably coupled respectively to the pair of seat mounting plates, a pair of base plates slidably coupled respectively to the pair of rear pivot links;

an ottoman crossbar coupled between the pair of seat mounting plates at the forward end;

a first ottoman mounting bracket coupled to the ottoman crossbar between the first side and the second side; and a first front ottoman link rotatably coupled to the first ottoman mounting bracket, a first lock link that is rotatably coupled to the first front ottoman link; and a first lock bracket that is fixedly coupled to the drive tube and rotatably coupled to the first lock link.

12. The assembly of claim 11, wherein the drive tube is rotatable relative to the pair of seat mounting plates, and wherein the ottoman crossbar is fixed relative to the pair of seat mounting plates.

13. The assembly of claim 12, wherein the ottoman crossbar further comprises:

a second ottoman mounting bracket coupled to the ottoman crossbar between the first side and the second side;

a second front ottoman link rotatably coupled to the second ottoman mounting bracket; and a second lock link rotatably coupled to the second front ottoman link; and a second lock bracket that is fixedly coupled to the drive tube and rotatably coupled to the second lock link.

14. The assembly of claim 13, further comprising:

a first rear ottoman link rotatably coupled to the first ottoman mounting bracket;

a first main ottoman link rotatably coupled to the first rear ottoman link;

a first footrest bracket coupled to the first main ottoman link;

a second rear ottoman link rotatably coupled to the second ottoman mounting bracket, a second main ottoman link rotatably coupled to the second rear ottoman link; and a second footrest bracket coupled to the second main ottoman link.

15. The assembly of claim 14, wherein the pair of footrest drive links are rotatably coupled to an inside of the pair of ottoman control links, respectively, and wherein the pair of lock mounting plates are rotatably coupled to an outside of the pair of ottoman control links, respectively.

16. The assembly of claim 15, further comprising a motor connection location on the drive tube, wherein the motor connection location is pivotable relative to the drive tube, and wherein the first and the second lock brackets are on opposite sides of the motor connection location.

17. The assembly of claim 16, wherein the ottoman crossbar has a first cross-sectional area and the drive tube has a second cross-sectional area, and wherein the first cross-sectional area is larger than the second cross-sectional area.

18. A method of assembling a motorized linkage mechanism for an adjustable seating unit having forward and rearward ends, and spaced apart first and second sides, the method comprising:

providing a pair of seat mounting plates;

coupling a back crossbar between the pair of seat mounting plates at the rearward end of the seating unit;

coupling an ottoman crossbar between the pair of seat mounting plates at the forward end of the seating unit;

coupling an ottoman drive tube assembly to the pair of seat mounting plates between the forward and rearward ends, the drive tube assembly comprising:

a pair of lock mounting plates coupled respectively to the pair of seat mounting plates, a pair of ottoman control links rotatably coupled respectively to the pair of lock mounting plates, a drive tube fixedly coupled to the pair of ottoman control links and extending at least partially between the first side and the second side of the seating unit;

a pair of footrest drive links having first and second ends, the pair of footrest drive links rotatably coupled respectively to the pair of ottoman control links at the first ends, a pair of rear pivot links, the pair of rear pivot links rotatably coupled respectively to the second ends of the pair of footrest drive links, the pair of rear pivot links being rotatably coupled respectively to the pair of seat mounting plates, a pair of base plates slidably coupled respectively to the pair of rear pivot links, a pair of lock brackets fixedly coupled to the drive tube between the first side and the second side, and inwardly spaced from the pair of seat mounting plates, and a pair of lock links rotatably coupled respectively to the pair of lock brackets and to the ottoman crossbar; and coupling a motorized drive mechanism to the back crossbar and to the drive tube.

19. The method of claim 18, further comprising:

rotatably coupling a first lock link of the pair of lock links to a first lock bracket of the pair of lock brackets;

rotatably coupling a second lock link of the pair of lock links to a second lock bracket of the pair of lock brackets;

rotatably coupling a first front ottoman link to the first lock link;

rotatably coupling a second front ottoman link to the second lock link;

fixedly coupling a first ottoman mounting bracket to the ottoman crossbar;

rotatably coupling the first front ottoman link to the ottoman crossbar at the first ottoman mounting bracket;

fixedly coupling a second ottoman mounting bracket to the ottoman crossbar; and rotatably coupling the second front ottoman link to the ottoman crossbar at the second ottoman mounting bracket.

20. The method of claim 18, wherein the pair of footrest drive links are on opposite sides of the seating unit and coupled respectively to an inside of the pair of ottoman control links.

* * * * *